US005402549A

United States Patent [19]

Forrest

[11] Patent Number: 5,402,549

[45] Date of Patent: Apr. 4, 1995

[54] TICKET SCRAPER

[76] Inventor: Jerry D. Forrest, P.O. Box 196, Sanford, Tex. 79078

[21] Appl. No.: 172,411

[22] Filed: Dec. 21, 1993

[51] Int. Cl.[6] ..... A46B 13/02

[52] U.S. Cl. ..... 15/88.3; 15/77; 15/308

[58] Field of Search ..... 15/38, 39, 88.3, 77, 15/412, 413, 21.2, 308, 311

[56] References Cited

U.S. PATENT DOCUMENTS

| | | | |
|---|---|---|---|
| 325,916 | 9/1885 | Daniels, Jr. | 15/77 |
| 329,863 | 11/1885 | Straker . | |
| 3,117,333 | 1/1964 | Murray et al. | 15/77 |
| 3,217,349 | 11/1965 | Hull et al. | 15/38 |
| 4,107,807 | 8/1978 | Nash, Jr. | 15/21.1 |
| 4,123,816 | 11/1978 | Lupo | 15/88.3 |
| 4,567,618 | 2/1986 | Picchietti, Sr. | 15/21.2 |
| 4,646,382 | 3/1987 | Smith | 15/236.01 |
| 4,765,842 | 8/1988 | Sanders et al. | 134/9 |
| 5,253,383 | 10/1993 | Clark | 15/88.3 |

*Primary Examiner*—Edward L. Roberts
*Attorney, Agent, or Firm*—Guy McClung

[57] ABSTRACT

A scraper for scraping a coating from a coupon, card, or ticket is disclosed which, in one aspect, has a scraping apparatus rotated by a motor mounted in a housing with a ticket holder into which a coated ticket, etc., is inserted. Rotation of the scraping apparatus scrapes the coating from the ticket. Apparatus is provided, in certain embodiments, to inhibit egress of scraped material from the scraper and a storage/collection member is also provided to receive the scraped material. Audio playback apparatus is provided to give announcements to a user of the apparatus.

15 Claims, 4 Drawing Sheets

TICKET SCRAPER

BACKGROUND OF THE INVENTION

1. Field of the Invention

This invention relates to scrapers for scraping material from cards, passes, or tickets and, in one specific aspect, to methods and devices for scraping coatings, e.g. butyl coatings, from lottery tickets.

2. Description of Related Art

A variety of coupons, game cards and lottery tickets have a portion which is covered by an opaque coating. By scraping the coating away a person sees what is shown or printed beneath the coating. The prior art reveals several devices and methods for removing this coating; for example, coins, knives, nail files, credit cards, and any device with a sharp edge, as well as the devices described below. None of these recognizes or addresses the problem presented by the undesirable dissemination of the coating material, particularly hazardous and/or carcinogenic material, to food storage and serving areas or to personnel in the area.

U.S. Pat. No. 4,765,842 discloses a ticket cleaner apparatus which removes a coating from the surface of a game ticket to reveal or expose characters on the ticket. The apparatus includes: a housing which includes an opening to receive the ticket; a rotatable cleaning element supported within the housing; positioning means adapted to position the ticket within the housing so that the coating on the ticket is in contact with the cleaning element; and power means which is adapted to rotate the cleaning element while in contact with the coating on the ticket.

U.S. Pat. No. 4,646,382 discloses a hand-held ticket scraper with a portion which is pressed down on the ticket as the ticket is moved to scrape away a coating.

U.S. Pat. No. 4,123,816 discloses fingernail cleaning apparatus that includes an electric motor with a drive shaft. A bristle brush is drivably connected to the motor drive shaft for rotation therewith. A reservoir for a cleaning liquid is positioned beneath the brush so that the bristles of the brush are rotatable within the confines of the reservoir. A base supports the motor and has partitions or supports for the drive shaft and brush. A housing encloses at least the brush and reservoir so as to shield the motor and the user of the apparatus from any spray of cleaning liquid generated.

U.S. Pat. No. 4,107,807 discloses a portable, tack cleaning machine having a housing which supports a horizontally-mounted rotary, cylindrical feeder-brush at least partially immersed in a cleaning fluid tank located in the bottom of the housing, and a rotary, scrubbing brush vertically mounted above and in contact with the feeder-brush. The brushes are powered by electric motors using an ordinary 60-cycle outlet as a power source. The housing has entrance and exit openings located adjacent the interface of the two brushes. In addition, the housing is hinged on one side along its longitudinal axis providing access to the brushes, tank, and driving assembly. A control clip is also disclosed for grasping and guiding a piece of tack to be cleaned through the machine.

U.S. Pat. No. 3,117,333 discloses a device for cleaning dust from microfilm frames mounted in data storage or processing cards. The device has a card feeding mechanism for feeding cards seriatim from a stack of cards in a supply tray to a conveyor mechanism for advancing the cards into contact with a pair of rotating brushes for removing dust particles from the cards and from the film mounted therein, the brushes mounted in an area in which a constantly reversing electrostatic field is generated to damp out or neutralize the static charge on the cards, means being provided to create a reduced pressure zone around the brushes to aid in the removal of dust particles from the cards.

U.S. Ser. Nos. 329,863; 325,916; and 235,328 disclose devices with rotating brushes mounted in housings for salvaging and saving gold leaf and particles normally wasted in book inscription and gilting processes.

There has long been a need for an effective ticket scraper which inhibits the spread of hazardous coating materials. There has long been a need for an efficient ticket scraper which is attractive to its users and which provides interactive communication with its users.

SUMMARY OF THE PRESENT INVENTION

The present invention, in one embodiment, discloses a ticket scraper with a housing in which is mounted a motor with a motor shaft extending therefrom. A scraping apparatus, e.g. a brush, cloth or other suitable item, is secured to the motor shaft and disposed adjacent a ticket holder so that as the scraping apparatus rotates it scrapes a coating from a ticket inserted into and held by the ticket holder. Preferably, in one aspect, coin or token activated control apparatus is interconnected between the motor and a power supply. In another aspect an inserted ticket activates a switch which in turn permits power to flow to the motor.

In certain embodiments according to the present invention the ticket holder includes a backing plate to provide pressure against a side of the ticket opposite the side having the coating. One or more micro switches may be used in conjunction with the ticket holder; e.g. one to start the scraping apparatus rotating as the ticket is first inserted into the ticket holder contacting the first micro switch, and then another to stop the scraping apparatus's rotation when the ticket is fully inserted into the ticket holder contacting the second micro switch. In a coin operated apparatus a timer interconnected with the motor permits the motor to run for a pre-set period sufficient for the scraping apparatus to scrape off the coating.

In certain embodiments according to the present invention a fan may be used to cool the motor and/or to suck air from the area of scraping in the housing inhibiting the egress of scraped coating particles from the housing.

In various embodiments an audio playback apparatus is interconnected with the scraping apparatus activation device so that a message is played for the person scraping a ticket. This message (which may be changed as desired) may contain operating instructions, general information, advertisements, public interest information, store products or sales information, etc.

In certain embodiments a drawer, bin, or bag is removably installed in or on the housing to receive and hold scraped material.

It is, therefore, an object of at least certain preferred embodiments of the present invention to provide:

New, useful, unique, efficient, nonobvious devices and methods for scraping coated coupons, cards, tickets, and lottery tickets;

Such methods and devices which inhibit the spread of hazardous coating materials and of carcinogenic coating materials, particularly to food storage and service areas and to personnel;

Such methods and devices with which scraped material is collected and stored;

Such devices which provide an audio and/or visual presentation or announcement to the user, including but not limited to operating instructions and ticket status; and Such devices which are interconnectible with a system apart from and/or remote from the device for providing processing and messages related to ticket status, amount won, etc.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this parent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 2:
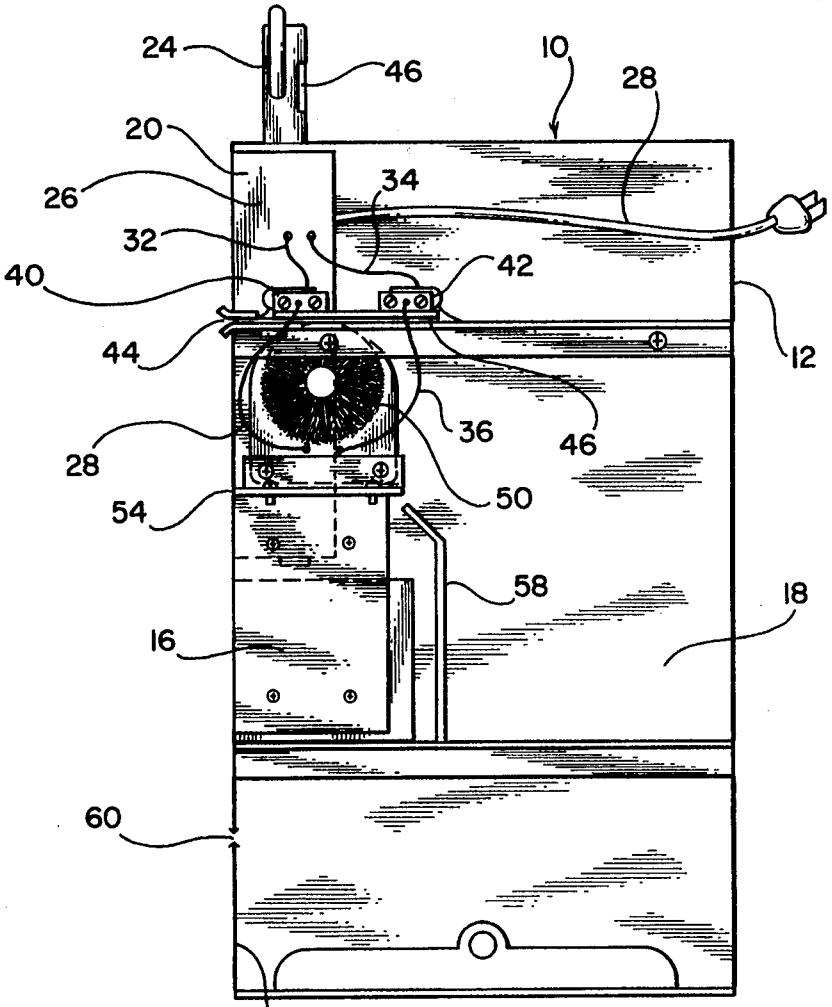
FIG. 2 is a side view of the device of FIG. 1.
Figure 1:
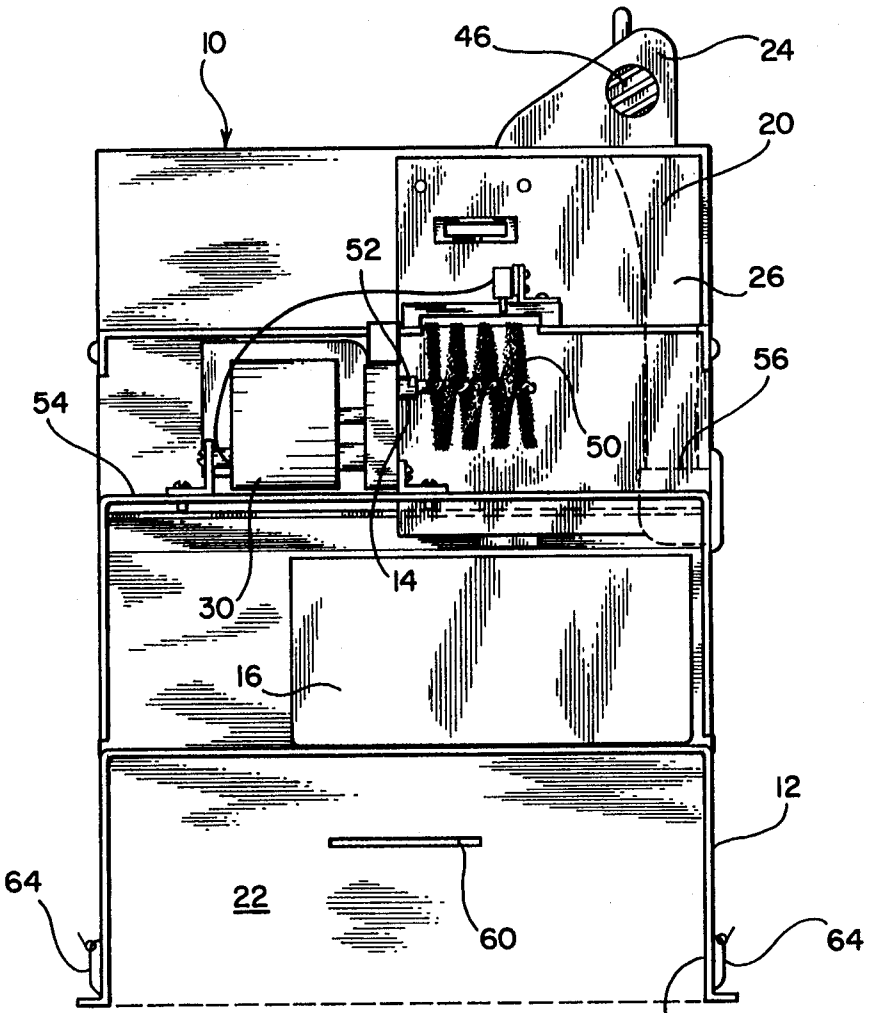
FIG. 1 is a front cut-away view of a device according to the present invention.
Figure 5:
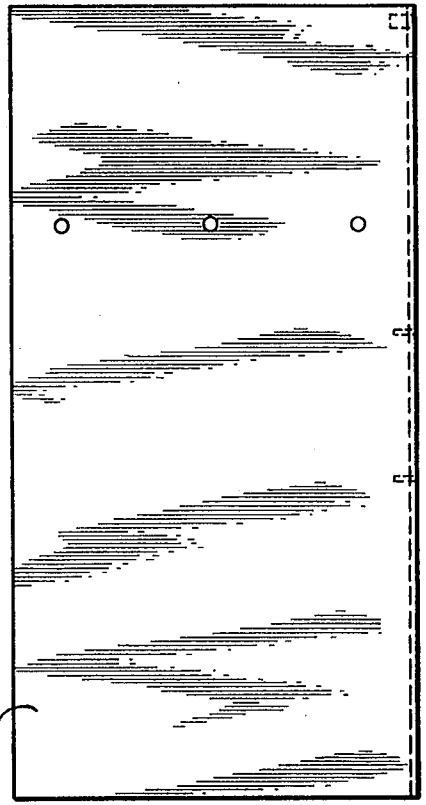
FIG. 5 is a side view of the device of FIG. 9.
Figure 4:
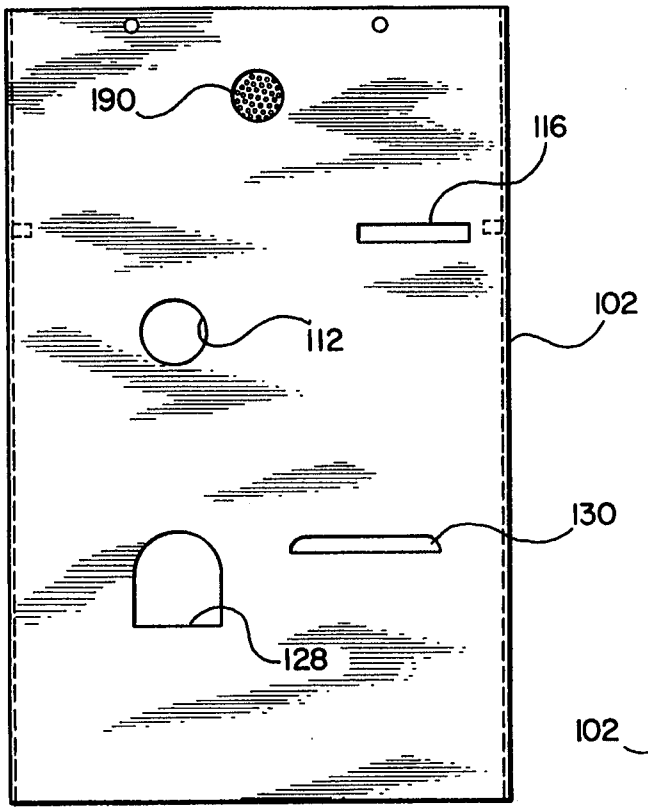
FIG. 4 is a front view of the device of FIG. 9.
Figure 3:
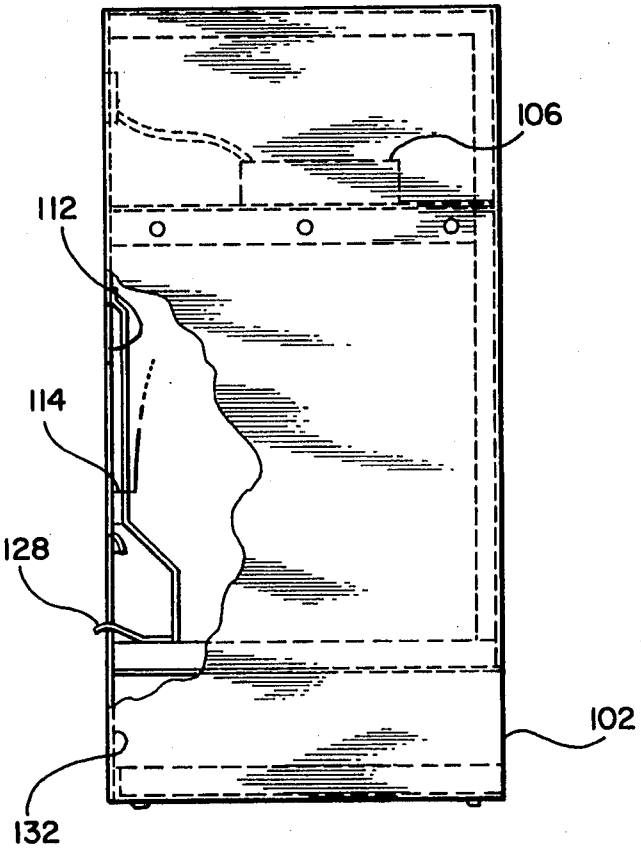
FIG. 3 is a side view partially cut-away of the device of FIG. 9.
Figure 6:
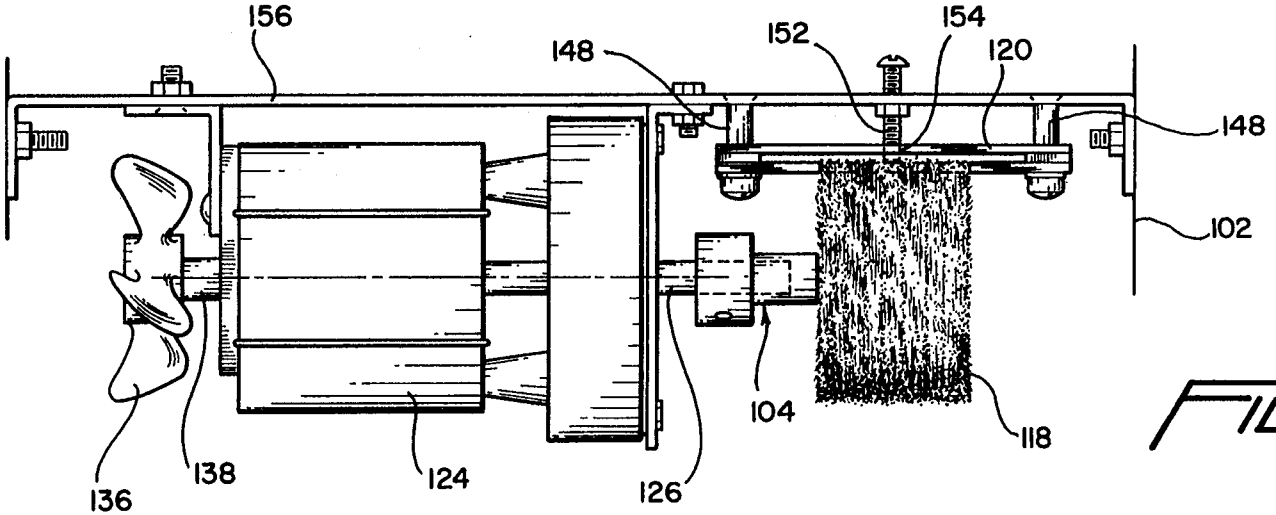
FIG. 6 is a partial cut-away view of the device of FIG. 9.
Figure 7:
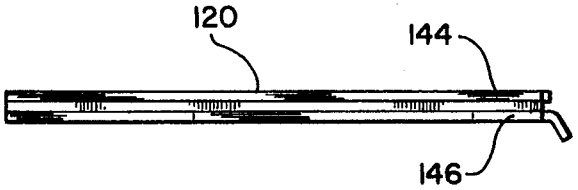
FIG. 7 is a side view of a ticket holder of FIG. 9.
Figure 8:
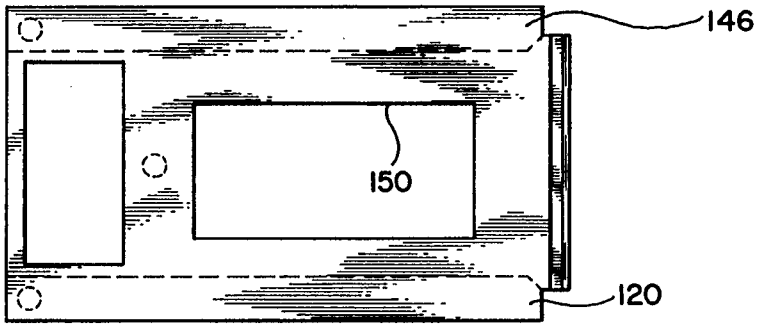
FIG. 8 is a bottom view of the ticket holder of FIG. 9.
Figure 10:
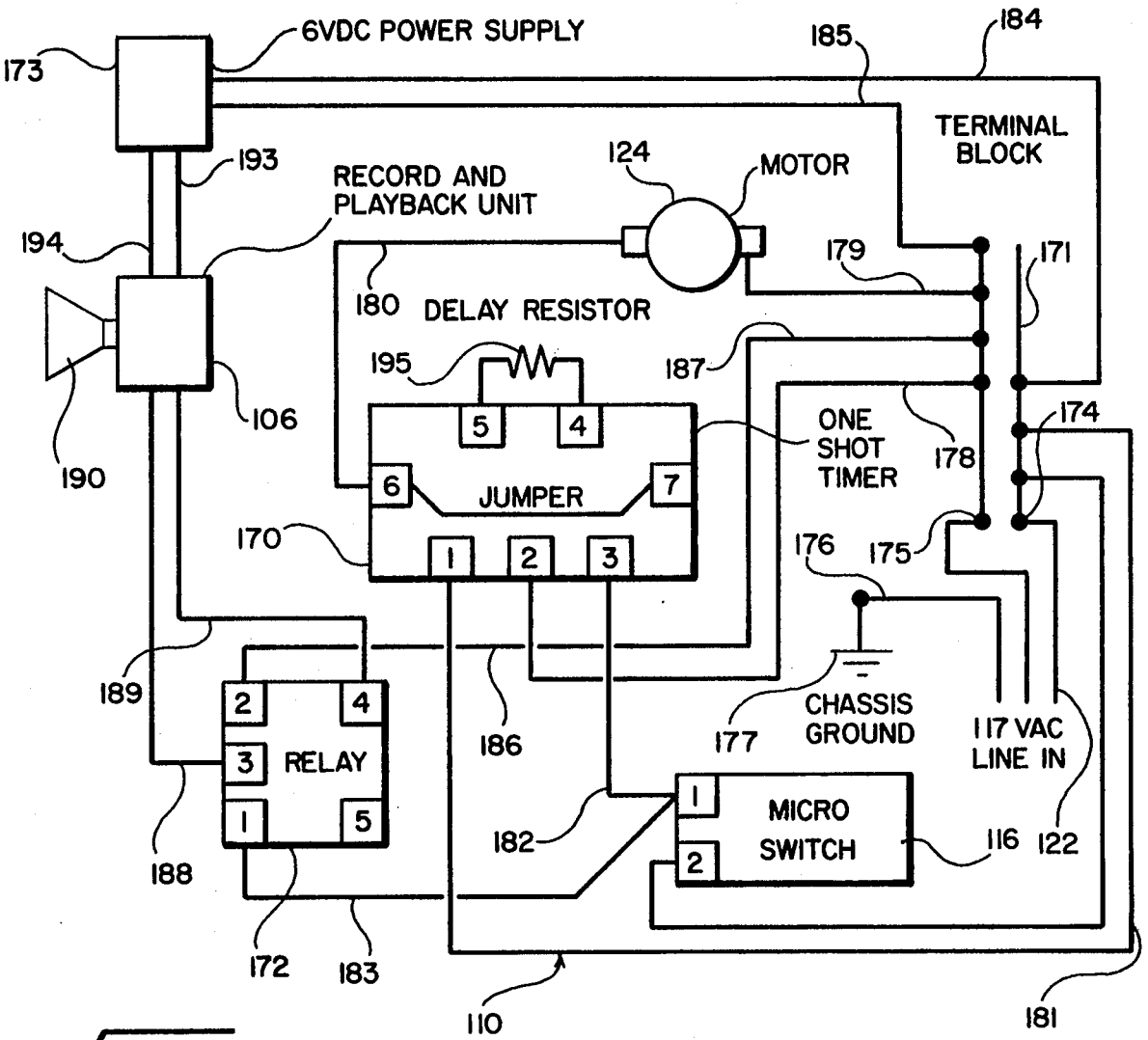
FIG. 10 is a schematic view of circuitry in the device of FIG. 9.
Figure 9:
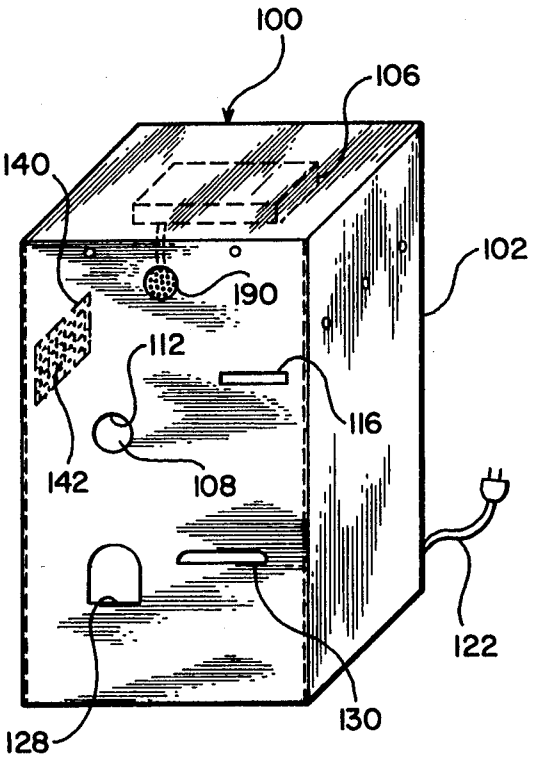
FIG. 9 is a perspective view of a device according to the present invention.

Referring now to FIG. 1, a device 10 according to the present invention has a housing 12, a scraping apparatus 14, a coin tray 16, a debris collection box 18, a coin mechanism 20, and a ticket box 22.

The coin activation mechanism includes a coin insert device 24 with a hole 46 into which a coin or token is inserted. The coin is sensed by a coin activation mechanism 26 which opens a power circuit from a power source (not shown) via power lines 28 and 32, 36, 38 to micro switches 40, 42, and to a motor 30 of the scraping apparatus 14. A coated ticket inserted into an opening 44 of a ticket holder 46 mounted to the housing above the scraping apparatus 14 contacts the first microswitch 40 turning on the motor 30. A scraping brush 50 connected to a shaft 52 of the motor 30 rotates and scrapes the ticket which has been inserted into the ticket holder 46. As the ticket is fully inserted into the ticket holder 46 it contacts the second micro switch 42 which opens the first micro switch and shuts off power to the motor 30 stopping the scraping of the ticket.

The motor 30 is mounted on a plate 54 which is mounted to the housing 12. A coin return 56 is provided when a re-usable token is employed to activate the device. Coating material scraped from a ticket falls down into a debris collection box 18. Scraped tickets are insertable through an opening 60 into the ticket box 22. A theft barrier 58 prevents access to the coin tray 16.

In one embodiment the housing 12 has a bottom opening 62 below which a bag or other receptacle may be positioned to receive and hold tickets inserted through the opening 60. Spring-loaded clamps 64 facilitate emplacement and holding of the bag about the opening 62.

Referring now to FIGS. 3–10, a device 100 according to the present invention has a housing 102 in which is mounted a scraping apparatus 104, a sound playback apparatus 106, a token-activated mechanism 108, and power/control apparatus 110.

A token inserted through an opening 112 in the housing 102 falls to contact a trip wire 114 opening a microswitch 116 of the power/control apparatus 110. A coated ticket inserted into the housing 102 through an opening 116 into a ticket holder 120 is disposed and held adjacent a brush 118 of the scraping apparatus 104. When the microswitch 116 is tripped by a token hitting the trip wire 114, power input to the device through a power line 122 is permitted to flow to a motor 124 with a shaft 126 on which is mounted the brush 118. The motor 124 is mounted to a plate 156 secured to the housing 102. Rotation of the shaft 126 rotates the brush 118 to scrape a coated ticket held in the ticket holder 120. Tokens may be retrieved from a token recess 128 and tickets may be inserted through an opening 130 in the housing 102 into a ticket box 132.

A fan 136 may be secured on an end 138 of the shaft 126 to cool the motor 124. By positioning a vent opening 140 in the housing 102 near the fan 136 and by rotating the fan so as to move air from the housing toward the vent opening 140, suction is provided from the area of the ticket holder 120 so that coating material does not exit through the opening 116. In one embodiment an appropriate screen or filter 142 may be emplaced over the opening 140 to insure that coating material is not expelled through the opening 140. Alternatively, with appropriate wiring, the fan may be secured to the housing near the opening.

The ticket holder 120 has a top plate 144 and a bottom plate 146 which are mounted to the housing 102 with bolts 148. A window 150 in the bottom plate 146 provides an area of brush access to a coated portion of a ticket inserted into the ticket holder 120. A pressure screw 152 extending through the housing 102 and contacting the plate 144 provides adjustable pressure on the ticket holder and thus on an inserted ticket so that the ticket is adequately pushed against the brush for effective scraping.

The power/control apparatus 110 has a one-shot timer 170, an input terminal block 171, a relay 172, a transformer 173, and the microswitch 116, all of which are conventional commercially available items. Input power is provided via the power line 122 to connections 174 and 175 on the input terminal block 171 and a line 176 is connected to earth ground 177. The one-shot timer 170 [e.g. a commercially available 4310A- 8-B-3, 2-1000—115 VAC, 5 amp interval/single shot timer (hi-power) (with terminals 6 and 7 connected together) from Ranger Company] is interconnected via lines 178, 179, 180 and 181 between the input terminal block 171 and the motor 124. The one-shot timer 170 is interconnected with the microswitch 116 via the line 182. The transformer 173 is interconnected with the input terminal block via lines 184, 185; the relay 172 is interconnected with the micro switch via a line 183 and with the input terminal block via a line 187; and the relay 172 is interconnected with the playback apparatus 106 via lines 188 and 189. Lines from the terminal block 171 are preferably filtered with 0.1 microfarad capacitors (not shown). The playback apparatus 106 is connected to the transformer 173 by the lines 193, 194.

In a typical cycle of operation a token trips the microswitch 116 which permits a pulse of current to flow to the one-shot timer 170 and to the relay 172. The timer 170 permits current to flow to the motor for a pre-set time period, e.g. about 18 seconds. Current flows from the relay 172 to the playback device 106 (e.g. a commercially available sealed solid state integrated recording pre-programmed device, from Advanced Technology Products, Inc. In one embodiment such a device includes a large speaker box; a small battery box with a switch; the small round silver microphone 190; a small clear LED; a recording switch; and a playback switch. Upon activation, the playback device 106 plays a message through a speaker 190, e.g. a greeting, an ad, and/or operating instructions. Certain available playback devices are re-programmable as desired. The timer 170 has a jumper line 191 between two of its terminals to provide single-shot timing for each token inserted into the device. The power delivered to the playback device 106 is power from the transformer 173 e.g. power at 6 volts. Preferably a delay resistor 195 is used with the one-shot timer 170.

In one embodiment a preferred brush is a 0.010 stainless steel bristled brush, about two inches in diameter with spiralled bristles in a left hand reverse twist single spiral e.g. as commercially available from Gordon Brush Mfg. Company, part no. 900044. In one embodiment, it is preferred that such a brush be rotated at 360 rpm.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized.

What is claimed is:

1. A ticket scraper for scraping a coating from a coated portion of a ticket, the scraper comprising a housing, the housing having a housing opening for insertion therethrough of a ticket to be scraped, the ticket having a coating on a portion thereof, a motor secured to a plate within the housing, a motor shaft extending from the motor, a brush secured to the motor shaft, a ticket holder mounted in the housing for receiving and holding the ticket to be scraped, the ticket holder having a top plate and a bottom plate spaced apart from the top plate so that a ticket is receivable between the top plate and the bottom plate, the ticket holder having a ticket receiving opening between the top plate and bottom plate, the ticket receiving opening disposed adjacent to the housing opening for receiving a ticket therefrom, the ticket holder having a window in the bottom plate defining a window opening adjacent which is disposed the coated portion of the ticket, the bottom plate covering a substantial portion of the ticket so it is not scraped, and the ticket holder disposed adjacent the brush so that the brush contacts the coating and so that rotation of the brush removes coating from the ticket.

2. The ticket scraper of claim 1 comprising also a fan mounted in the housing for sucking air from space about the ticket holder to inhibit egress of coating material out through the housing opening.

3. The ticket scraper of claim 2 wherein the fan is mounted on a shaft of the motor.

4. The scraper of claim 2 comprising also a vent opening through the housing adjacent the fan.

5. The scraper of claim 4 comprising also a screen over the vent opening.

6. The ticket scraper of claim 1 comprising also token activating apparatus for activating the motor, the apparatus activated by a token inserted thereinto, playback apparatus with a microphone for providing an audio announcement upon activation by the token inserted into the token activating apparatus, and control apparatus interconnected between the token activating apparatus and the playback apparatus for controlling the playback apparatus.

7. The scraper of claim 6 wherein the control apparatus includes a single-shot timer and provides power to the motor for rotating the brush for a pre-set time interval.

8. The scraper of claim 7 wherein the time interval is about 18 seconds.

9. The scraper of claim 1 comprising also pressure adjustment apparatus for adjustably biasing the ticket against the brush.

10. The scraper of claim 1 comprising also a ticket container in the housing, and a ticket slot through the housing through which scraped tickets are insertable into the ticket container.

11. The scraper of claim 1 comprising also the housing having a bottom opening through which the ticket may pass, clip apparatus for removably attaching a ticket bag to the housing at the bottom opening for receiving a ticket falling through the housing, and a ticket slot through the housing through which scraped tickets are insertable to fall into the ticket bag.

12. The scraper of claim 1 comprising also a coating collection container in the housing for receiving and holding coating scraped from the ticket.

13. The scraper of claim 12 wherein the coating collection container is removably disposed in the housing.

14. A ticket scraper for scraping a coating from a coated portion of a ticket, the scraper comprising a housing, the housing having an opening for insertion therethrough of a ticket to be scraped, the ticket having a coating on a portion thereof, a motor secured to a plate within the housing, a motor shaft extending from the motor, a brush secured to the motor shaft, a ticket holder mounted in the housing for receiving and holding the ticket to be scraped, the ticket holder having a top plate and a bottom plate spaced apart from the top plate so that a ticket is receivable between the top plate and the bottom plate, the ticket holder having a ticket receiving opening between the top plate and bottom plate, the ticket receiving opening disposed adjacent to the housing opening for receiving a ticket therefrom, the ticket holder having a window in the bottom plate defining a window opening adjacent which is disposed the coated portion of the ticket, the bottom plate covering a substantial portion of the ticket so it is not scraped, and the ticket holder disposed adjacent the brush so that the brush contacts the coating and so that rotation of the brush removes coating from the ticket, a fan mounted in the housing for sucking air from space about the ticket holder to inhibit egress of coating material out through the housing opening, token activating apparatus for activating the motor activated by a token inserted thereinto, playback apparatus with a microphone for providing an audio announcement upon activation by the token inserted into the token activating apparatus, and control apparatus interconnected between the token activating apparatus and the playback apparatus for controlling the playback apparatus, the control apparatus including a single-shot timer and providing power to the motor for rotating the brush for a pre-set time interval, and pressure adjustment apparatus for adjustably biasing the ticket against the brush.

15. A ticket scraper for scraping a coating from a coated portion of a ticket, the scraper comprising a housing, the housing having an opening for insertion therethrough of a ticket to be scraped, the ticket having a coating on a portion thereof, a motor secured to a plate within the housing, a motor shaft extending from the motor, a brush secured to the motor shaft, a ticket holder mounted in the housing for receiving and holding the ticket to be scraped, the ticket holder having a top plate and a bottom plate spaced apart from the top plate so that a ticket is receivable between the top plate and the bottom plate, the ticket holder having a ticket receiving opening between the top plate and bottom plate, the ticket receiving opening disposed adjacent to the housing opening for receiving a ticket therefrom, the ticket holder having a window in the bottom plate defining a window opening adjacent which is disposed the coated portion of the ticket, the bottom plate covering a substantial uncoated portion of the ticket so it is not scraped, and the ticket holder disposed adjacent the brush so that the brush contacts the coating and so that rotation of the brush removes the coating from the ticket, a fan mounted in the housing for sucking air from space about the ticket holder to inhibit egress of coating material out through the housing opening, the fan mounted on a shaft of the motor, token activating apparatus for activating the motor activated by a token inserted thereinto, playback apparatus with a microphone for providing an audio announcement upon activation by the token inserted into the token activating apparatus, control apparatus interconnected between the token activating apparatus and the playback apparatus for controlling the playback apparatus, the control apparatus including a single-shot timer and providing power to the motor for rotating the brush for a pre-set time interval, pressure adjustment apparatus for adjustably biasing the ticket against the brush, a vent opening through the housing adjacent the fan, a ticket container in the housing, a ticket slot through the housing through which scraped tickets are insertable into the ticket container, and the ticket holder having a window in the bottom plate defining a window opening adjacent which is disposed the coated portion of the ticket, the window members covering a substantial uncoated portion of the ticket so it is not scraped.

* * * * *